US006546875B2

(12) United States Patent
Vaughn et al.

(10) Patent No.: US 6,546,875 B2
(45) Date of Patent: Apr. 15, 2003

(54) NON-LEAD HOLLOW POINT BULLET

(75) Inventors: Norman L. Vaughn, Knoxville, TN (US); Richard A. Lowden, Clinton, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/840,250

(22) Filed: Apr. 23, 2001

(65) Prior Publication Data

US 2002/0152915 A1 Oct. 24, 2002

(51) Int. Cl.[7] ..... F42B 12/34
(52) U.S. Cl. ..... 102/507; 102/517
(58) Field of Search ..... 102/501, 507–510, 102/514–517, 518, 519

(56) References Cited

U.S. PATENT DOCUMENTS

| | | | | |
|---|---|---|---|---|
| 3,881,421 A | | 5/1975 | Burczynski | |
| 4,517,898 A | | 5/1985 | Davis et al. | |
| 4,610,061 A | | 9/1986 | Halverson | |
| 4,949,645 A | | 8/1990 | Hayward et al. | |
| 5,079,814 A | | 1/1992 | Moore et al. | |
| 5,101,732 A | | 4/1992 | Schluckebier | |
| 5,208,424 A | | 5/1993 | Schluckebier | |
| 5,237,930 A | | 8/1993 | Belanger et al. | |
| 5,357,866 A | | 10/1994 | Schluckebier et al. | |
| 5,535,678 A | | 7/1996 | Brown | |
| 5,616,642 A | | 4/1997 | West et al. | |
| 5,722,035 A | | 2/1998 | Matysik et al. | |
| 5,760,331 A | | 6/1998 | Lowden et al. | |
| 5,811,723 A | | 9/1998 | Stone | |
| 5,852,255 A | | 12/1998 | Hallis et al. | |
| 6,016,754 A | | 1/2000 | Enlow et al. | |
| 6,085,661 A | | 7/2000 | Halverson et al. | |
| 6,182,574 B1 | * | 2/2001 | Giannoni | 102/516 |

FOREIGN PATENT DOCUMENTS

| | | | | |
|---|---|---|---|---|
| DE | 3638721 | * | 5/1987 | 102/509 |
| DE | 19930474 | * | 1/2001 | 102/508 |
| WO | WO9720185 A1 | | 6/1997 | |

* cited by examiner

*Primary Examiner*—Harold J. Tudor
(74) *Attorney, Agent, or Firm*—Kirk A. Wilson

(57) ABSTRACT

The non-lead hollow point bullet of the instant invention comprises a mixed construction slug further comprising, a monolithic metal insert having a tapered (preferred conical) hollow point tip and a tapered (preferred conical) tail protrusion, and an unsintered powdered metal composite core in tandem alignment with the insert. The core has a hollow tapered (preferred conical) cavity tip portion coupled with the tapered (preferred conical) tail protrusion on the insert. An open tip jacket envelops at least a portion of the insert and the core. The jacket is swaged at the open tip.

7 Claims, 5 Drawing Sheets

NON-LEAD HOLLOW POINT BULLET

STATEMENT REGARDING FEDERAL SPONSORSHIP

This invention was made with Government support under contract no. DE-AC05-00OR22725 to UT-Battelle, LLC, awarded by the United States Department of Energy. The Government has certain rights in the invention.

BACKGROUND OF THE INVENTION

The firing of small arms ammunition for training, sporting, law enforcement, and military purposes is a major source of environmental pollution, which poses a health hazard to the world population. Lead is a significant environmental and health problem at the numerous public, private, and government-operated shooting ranges. Many of the sites are contaminated with hundreds of tons of lead, the result of years of target practice and skeet shooting. The lead is tainting grounds and water, and is being ingested by wildlife, and thus has become a serious threat to the health and safety of human and animal populations. Indoor ranges pose other serious concerns such as increased lead exposure to the shooter due to the enclosed space and the subsequent need for high capacity ventilation and air filtration systems. Handling of ammunition and contaminated weapons can also produce elevated lead levels in the blood by absorption through the skin.

Since lead is a hazardous material, bullets are being fabricated from alternate metals such as monolithic copper, powder metals in polymer binders, and other mixtures that include powdered metals. Many of the bullets made from the alternate materials are atypical in size and shape because the materials do not have densities less than lead. Emphasis in the development of non-lead bullets has been on products for training where it is believed that these deficits in properties are not of concern. Non-lead bullets for use in service have had little attention. Though many bullet configurations have been produced using non-lead materials, no non-lead hollow-points that mimic the exact shape, design, size, and function of lead hollow-points have been developed.

Full-metal jacket and "soft-point" bullets are not favored for use by law enforcement and security forces. These designs do not readily expand in soft targets and thus over penetrate. The bullets can pass completely through one target and into others. The energy of the bullet is not completely deposited in the target thus less likely producing the desired effect, a one shot stop. These types of bullets also cause more collateral damage and ricochet more easily. Law enforcement and other security and protective forces prefer to use "hollow-point" (HP) bullets to overcome these issues. A hollow cavity is intentionally created in the exposed soft lead nose of the bullet. Upon engaging a soft target, the nose of the bullet quickly expands. The energy of the bullet is thus rapidly deposited in the target. More recent designs incorporate scored or serrated copper jackets, which adds additional control to the expansion process.

Maximum expansion of the head is desirable to maximize hemorrhaging and tissue damage. This maximized expansion maximizes the lethality in game animals. However, if the head expands too much, the bullet will separate into segments which limits the penetration. Accordingly, to obtain significant depth of penetration, the mass of the bullet must remain behind the head.

Hollow point jacketed bullets are well known and are typically made of a lead alloy with a jacket typically made of a copper alloy. The jacket generally covers at least part of the nose or ogive and all of the cylindrical body portions of the bullet. Expansion is obtained by providing a hollow in the front end of the bullet. This type of jacketed bullet produces controlled expansion in soft body tissue. The front end may also be formed with cuts and/or ribs in the jacket or with cuts or ribs in the core within the hollow tip to further control the expansion upon penetration into soft tissue. One typical hollow point jacketed bullet is described in U.S. Pat. No. 3,157,137. A jacketed bullet with a rosette type of hollow point formed entirely from the open jacket end is disclosed. Another is U.S. Pat. No. 3,349,711 describes a bullet which has external cuts in the ogive portion of the full metal jacket around the hollow tip. Another example is U.S. Pat. No. 4,550,662, in which is discussed a bullet where the hollow tip is formed with axially extending ribs in the soft metal core. Another hollow point jacketed bullet, using aluminum for the jacket, is disclosed in U.S. Pat. No. 4,610,061. In this patent, the jacket extends part way into the hollow and cuts are made in the jacket at the rim of the hollow point to control deformation and ripping of the jacket during expansion. All of the bullets provide relatively predictable expansion in soft tissue, and all are fabricated employing similar techniques; a hollow cavity is formed in a lead core which is seated in a thin metal cup or jacket.

The fabrication of a bullet with controlled expansion employing non-lead materials is not trivial. Functional hollow point bullets are being fabricated from copper; however, ballistic performance suffers due to the lower density of the copper as compared to lead. A hollow-point made using the plastic-bonded powder metal composite materials does not expand, but instead fragments in a soft target. Jacketed bullets are also being fabricated from bismuth and zinc; however, hollow-point or expanding bullets are not described.

Hollow-point bullets fabricated from mixtures of tin and tungsten or zinc and tungsten employing a sinterless powder metallurgy technique following U.S. Pat. No. 5,760,331, herein incorporated by reference, were found to fragment. This bullet is shown in FIG. 4. Fragmentation is undesirable for penetration is minimized and because of forensic and medical concerns. A process to produce a powder metal hunting bullet with a hollow point is described in U.S. Pat. No. 5,722,035. The disclosed embodiment was made from copper or mixtures of copper and tungsten powders, and was pressed and sintered. The performance characteristics of the materials and bullet were not discussed.

No-lead, full-metal jacket and hollow-point bullets are described in foreign patent WO9720185, and details a pistol bullet with a two-piece core, made using two separate materials with different properties. The first portion or segment fills the base of the bullet, and the second piece fills the nose. The first portion is hard and possibly frangible, with materials such as sintered powdered metals or plastic-bonded metals being examples of possible materials. The second is soft and ductile as to permit mushrooming. Emphasis for the nose is placed on zinc or aluminum. A hollow-point with the cavity in the softer nose section is included. The construction of the HP bullets resembles the first unsuccessful version of the bullets described in this invention. Gluing the cores together reportedly solves the problem of separation of the first and second portion of the bullet core. No teaching of shaping the cores during seating to prevent separation and enhance expansion is provided. Construction of HP bullets resembling the examples given in WO9720185 was unsuccessful.

A two-component core has been described for use in a soft-point rifle bullet for hunting (Brenneke TIG or TUG), but involved lead alloys with differing properties. In U.S. Pat. Nos. 5,237,930 and 5,616,642, and similar technologies, powdered metals are mixed with polymer binders, typically nylon. Bullets are formed by melting and molding of the plastic-metal mixture. Although hollow cavities are readily formed in a bullet fabricated from the materials, the plastic-metal composite does not expand. The composite is frangible thus fragments into particles. In addition the density of the polymer-metal composites is less than that of lead thus bullets made from these materials are atypical in size when trying to match the weights of similar designs.

Solid copper hollow-point bullets are described in U.S. Pat. Nos. 5,811,723 and 5,259,320. Annealed copper is soft and through combinations of hollow cavities, slots and grooves, expansion can be achieved. The density of copper however, is 8.9 g/cm$^3$ which again results in bullets that are either lighter than those made with lead or atypical in size.

Bismuth and zinc have been used to fabricate bullets in U.S. Pat. Nos. 5,852,255 and 5,535,678 but no hollow-point are described. As with copper the densities for these metals, 9.8 and 7.1 g/cm$^3$, respectively are lower than lead. Also, these metals are not as ductile as copper or lead. It would be expected that HP bullets made from these metals would be brittle and therefore fragment upon impact.

In prior lead hollow-point bullet designs, the hollow-point cavity in the lead core or in a combination of a jacket and the core is formed with a number of sharp corners or with a plurality of radial slits (e.g. U.S. Pat. No. 5,101,732). In these prior designs, a punch with a polygonal shape is used instead with a smooth tapered (preferred conical) shape is used. This produces sharp edges within the cavity which enhances failure along these distinct lines. This permits better control of expansion or "petaling" of the nose of the bullet. This technique was used to produce the cavity in examples fabricated in the aforementioned non-lead bullets. When test fired into 10% ballistic gelatin, the hollow-points expanded and petaled along the radial slits.

The alteration of weight distribution to improve accuracy is described in U.S. Pat. No. 4,517,898 and includes a description of a simple, truncated-cone, hollow-point bullet or a bullet with layers of materials within the core with varying densities.

Bullets made during development of the instant invention were fabricated employing tin in the nose section and a powder metal product in the base. Upon firing from a pistol at 900–1300 ft/sec into 10% ballistic gelatin at a distance of 5–10 yards, the soft metal insert in the nose of the bullet expanded and split, and then separated from the base of the assembly. The powder metal core in the base of the bullet was exposed, and then fragmented and dispersed throughout the gelatin. This separation was noted to be unacceptable and although variations upon this theme were attempted, the problem of separation of the first and second portions of the bullet core could not be solved. Modifications to the procedure and designs were required to prevent separation of the core segments.

BRIEF SUMMARY OF THE INVENTION

Fully functional non-lead hollow-point bullets that duplicate the designs, shapes, weights, and sizes of lead hollow-point bullets have been produced employing a mixed construction technique that uses a powdered metal core and a monolithic metal insert. The monolithic metal insert permits expansion while the powder metal core provides mass. This technique permits the construction of hollow-point bullets using non-lead, less toxic, materials that mimic the size, dimensions, and designs currently used for lead-containing products. The non-lead hollow-points exhibit exceptional performance when tested in 10% ballistic gelatin with >80% expansion in diameter and 100% weight retention.

The non-lead hollow point bullet of the instant invention comprises a mixed construction slug further comprising, a monolithic metal insert having a tapered (preferred conical) hollow point tip and a tapered (preferred conical) tail protrusion, and an unsintered powdered metal composite core in tandem alignment with the insert. The unsintered powdered metal composite core is not monolithic. The core has a hollow tapered (preferred conical) cavity tip portion coupled with the tapered (preferred conical) tail protrusion on the insert. An open tip jacket envelops at least a portion of the insert and the core. The jacket is swaged at the open tip.

DETAILED DESCRIPTION

A combined construction technique was developed to take advantage of the properties of the previously developed non-lead composite replacement for lead. In the fabrication of various bullet designs using the unsintered powder metal composite, fragmentation of the material during the formation of small diameter sections or sharp edges was observed. It was discovered that the insertion of a "cap" made from rolled or extruded material (metal or polymer) on top of the powdered metal (PM) core during seating solved the problem. The cap deforms and flows more easily than the powder metal product. This addition improved formability and prevents the PM composite from fragmenting. A small loose fragment in the nose of a bullet has a deleterious effect on accuracy.

It was also discovered that this combined construction technique could be applied to the fabrication of non-lead hollow-point bullets. By combining materials, hollow-point (HP) bullets that mimic the dimensions, weight, and terminal performance of their lead-containing analogs were fabricated. A mixed construction technique uses a powdered metal core and a monolithic metal insert to replace the slug, the materials that fill the inside of ajacket to produce a bullet. The monolithic metal insert permits expansion while the powder metal core provides mass.

Initial prototypes were made following procedures employed in the fabrication of lead hollow-point bullets.

Figure 3:
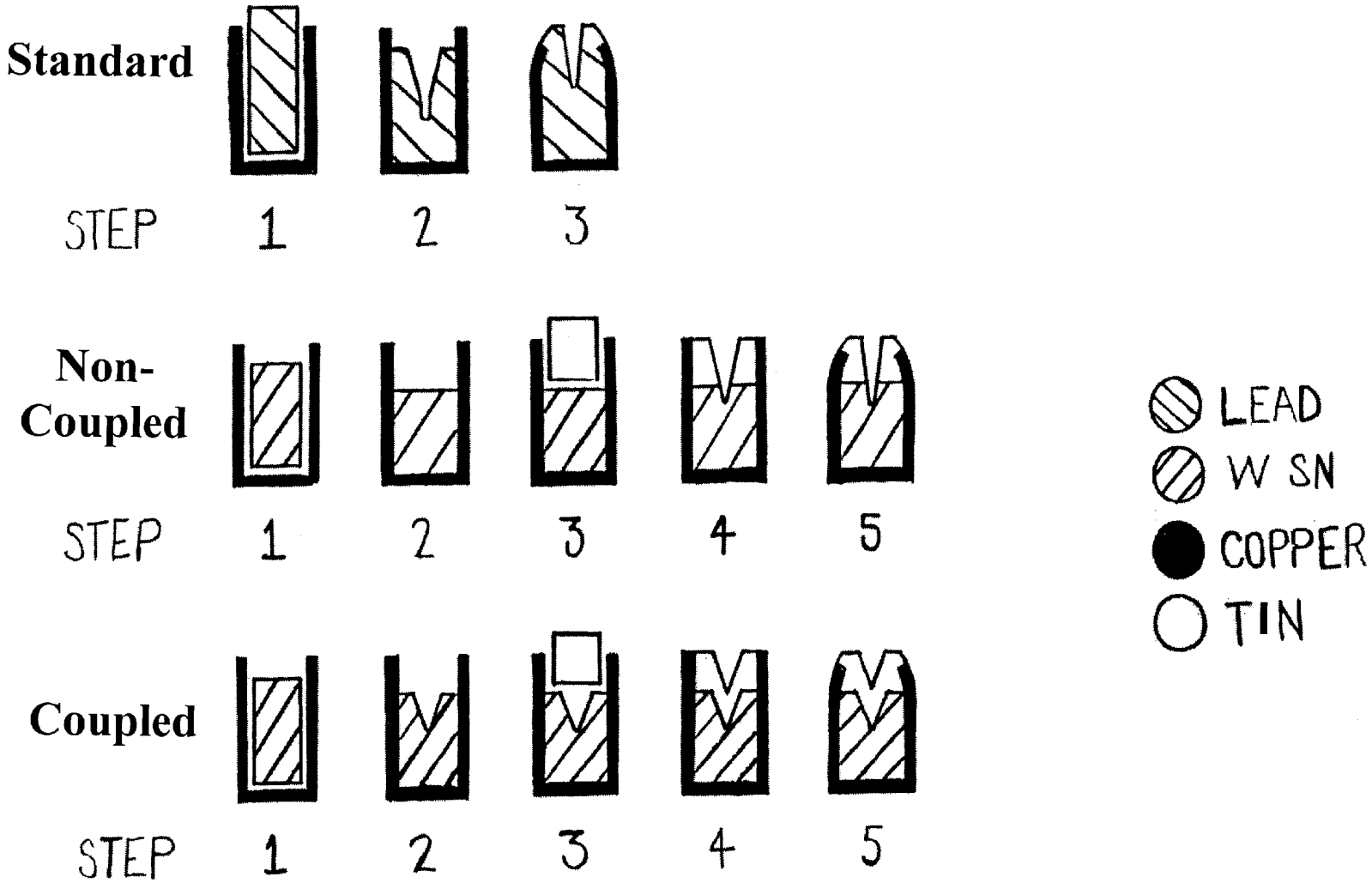
FIG. 3: Diagram of the fabrication process for the non-lead hollow-point bullet.
Figure 4:
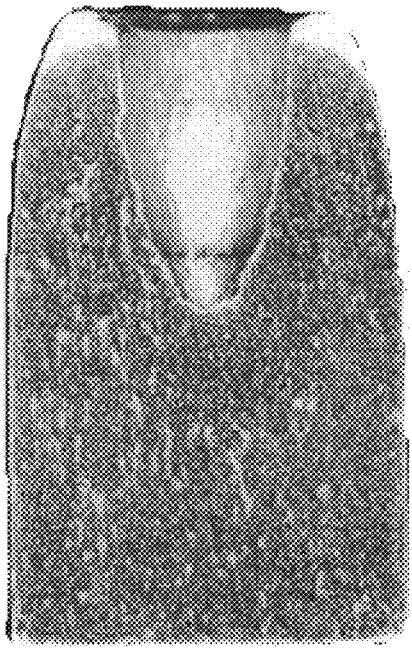
FIG. 4: A tungsten-tin composite hollow-point bullet fabricated employing a sinterless powder metallurgy technique. This bullet fragments in a soft-target.
Figure 5:
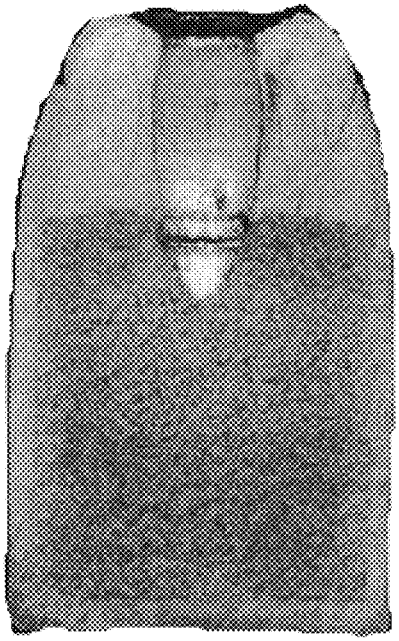
FIG. 5: Initial prototype that separated and fragmented during testing in gelatin.

Commercially available lead HP bullets were analyzed and designs for non-lead versions were developed. It was determined that a bullet with an 80 grain tungsten-tin (W-Sn) composite core, a 40 grain monolithic tin insert, and a 20 grain copper alloy jacket could be used to produce a 140 grain 38 caliber hollow-point bullet that matched the dimensions and weight of the lead design. The invention required a mixture of 75 wt % tungsten and 25 wt % tin which produces a material with a density of ~14 g/cm$^3$. An 80-grain composite core 0.309" diameter was fabricated by compressing the W-Sn mixture at room temperature and 50,000-psig pressure. The core was seated in a 0.500" long 0.357" diameter copper alloy cup or jacket using a hand press, the appropriate die, and a punch with a flat face. The inside diameter of the jacket had been "scored" along six equally spaced longitudinal lines to promote failure during expansion. A 40-grain tin insert fabricated from extruded material was then seated on top of the PM core using a punch that produced a hollow tapered (preferred conical) cavity in the tin. Another die and punch were used to form a nose on the bullet. This produced a 140 grain hollow-point 38 caliber bullet the cross section of which is shown in FIG. 5. The bullet in FIG. 5 was manufactured using non-coupled steps of FIG. 3.

Upon firing from a pistol at ~1300 ft/sec into 10% ballistic gelatin at a distance of 5 yards, the monolithic metal insert in the nose of the bullet expanded into a ring which split and separated from the base of the assembly. The powder metal core in the base of the bullet was uncovered, and thus fragmented and dispersed throughout the gelatin. This was unacceptable behavior thus new technique and procedures were developed.

Figure 1:
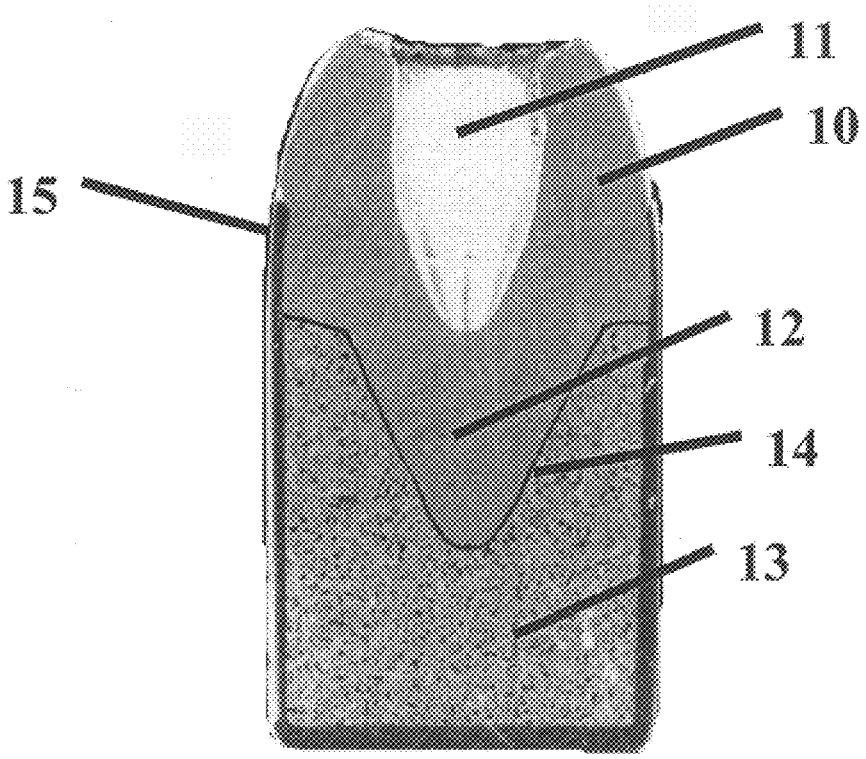
FIG. 1: Cross-section of a 140 grain 38 caliber non-lead hollow-point bullet.
Figure 2:
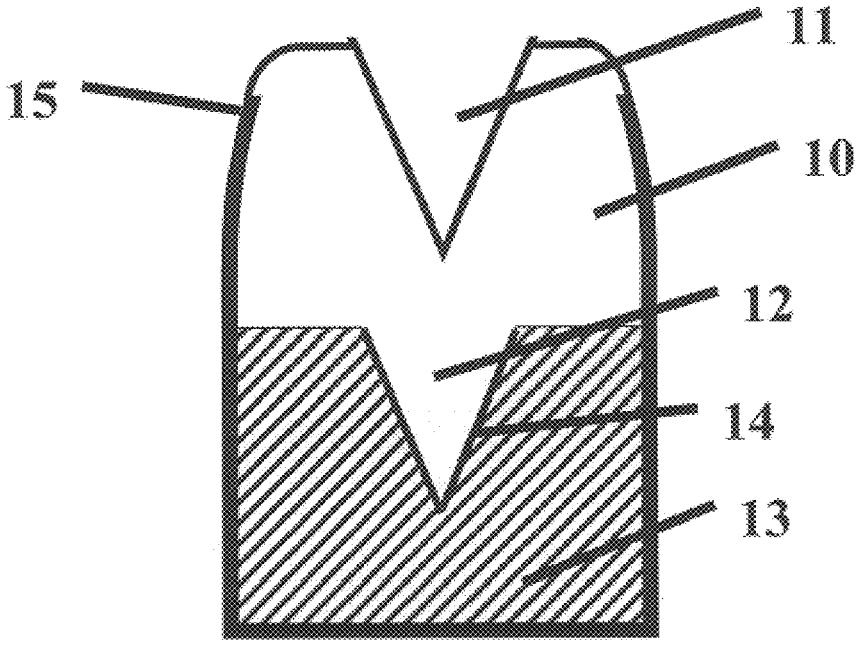
FIG. 2: A schematic cross section of the hollow tapered (preferred conical) cavity tip portion of the powdered metal core.

The same components were used in the improved version, however the process was altered. The powder metal core was seated with a punch that created a hollow tapered (preferred conical) cavity in the material and not a flat face. The tin cap was then seated on top of the PM core, also using a punch that produced a hollow tapered (preferred conical) cavity. Last, the bullet nose was swaged into either a round nose shape or a truncated cone. The procedure is summarized in the coupled steps of FIG. 3, and an example of a cross section of a bullet is shown in FIGS. 1 and 2. The non-lead hollow point bullet of the instant invention comprises a mixed construction slug further comprising, a monolithic metal insert 10 having a tapered (preferred conical) hollow point tip 11 and a tapered (preferred conical) tail protrusion 12, and an unsintered powdered metal composite core 13 in tandem alignment with the insert 10. The core 13 has a hollow tapered (preferred conical) cavity tip portion 14 coupled with the tapered (preferred conical) tail protrusion 12 on the insert 10. An open tip jacket 15 envelops at least a portion of the insert 10 and the core 13. The jacket 15 is swaged at the open tip.

Figure 6:
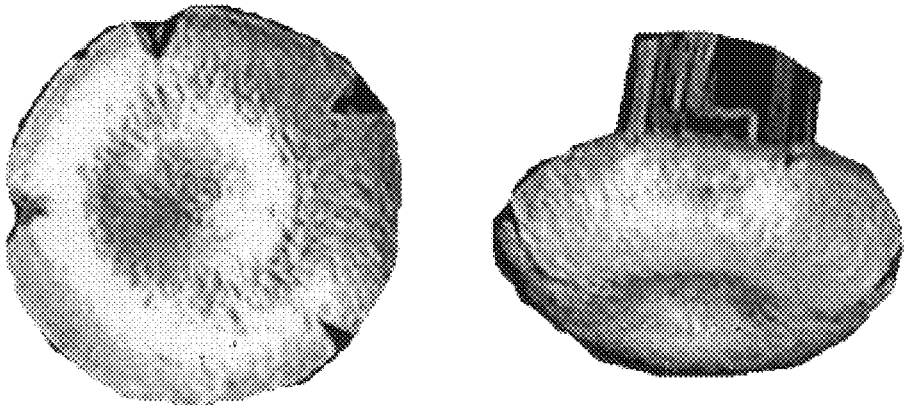
FIG. 6: Examples of 140 grain 38 caliber non-lead hollow-points recovered from ballistic gelatin.
Figure 7:
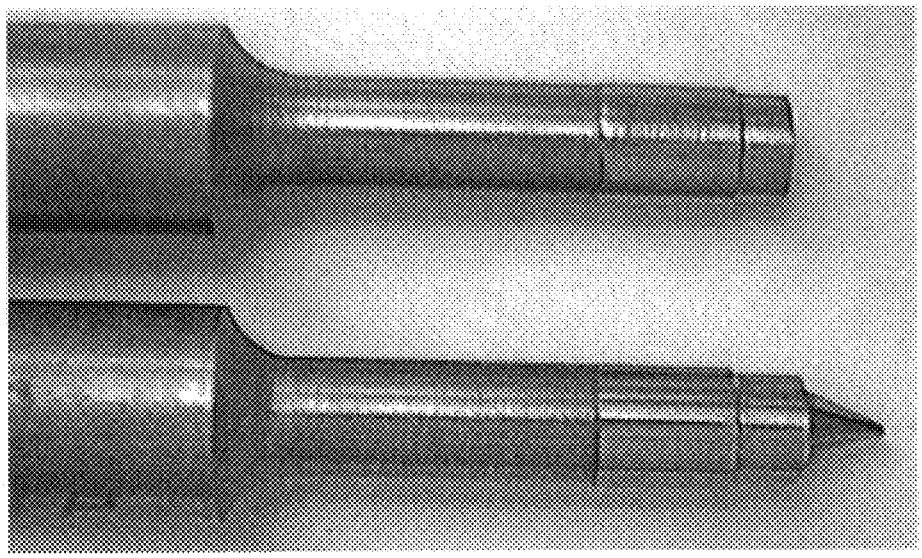
FIG. 7. Punches used to form the hollow-cavity in the nose of a bullet, standard core punch on top, hollow point core on bottom.
Figure 8:
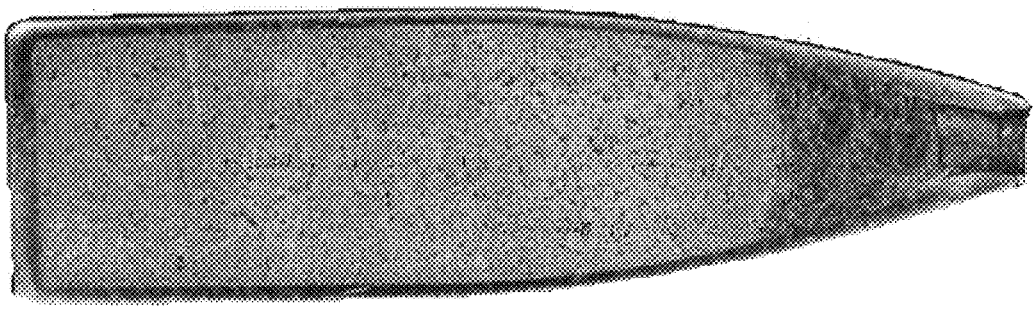
FIG. 8. Small caliber rifle bullet with mixed construction slug.

These bullets were tested fired from a pistol into 10% ballistic gelatin. The hollow-points penetrated 14 to 15 inches into the gelatin and expanded to a diameter approximately 90% greater than their starting caliber as shown in FIG. 6. The bullets were also found to retain 100% of their initial weight. Additional bullets in other calibers were fabricated employing the given materials and test fired at different velocities with similar results. In addition, due to changes in weight distribution, the bullets showed improved accuracy as compared to lead hollow-point of similar construction but with a homogeneous core.

The bullet described in this invention has numerous unique features including the use of non-lead materials, a core made from a monolithic metal and powdered metals, the ability to match lead bullet designs, sizes, performance, and weights exactly, and controlled weight distribution.

The non-lead hollow-point bullet is distinguishable from previous art containing lead by the simple fact that the new bullet does not contain lead or any of its alloys. The bullet of this invention utilizes materials that are not hazardous to humans or the environment. The non-lead hollow-point bullet of this invention also uses a two-component core. Also, an embodiment of this invention focuses on tin and a tin-tungsten composite. No sintering is needed.

Another advantage of the two-component core is the improvement in accuracy due to redistribution of weight, thus changes in center of gravity. The embodiment in the instant invention utilizes a multilayer structure and a hollow-point for controlled expansion in a soft target. Improved accuracy is an additional benefit of the instant invention.

In an alternate embodiment, the metal cap could be replaced with a metal other than tin, or a soft polymer and the PM core density adjusted to match the instant invention. An unjacketed version may be possible as well as a plated design. Alternate jacket materials such as aluminum or plastic may be used. Alternate powder metal mixtures and metal insert materials could be employed. The concept could also be extended to rifle bullets for hunting purposes.

We claim:

1. A non-lead hollow point bullet comprising:

a mixed construction slug further comprising, a monolithic metal insert having a hollow point tip and a tail protrusion, an unsintered powdered metal composite core in tandem alignment with said insert, said core having a hollow cavity tip portion coupled with said tail protrusion, a jacket having an open tip and enveloping at least a portion of said insert and said core, said jacket swaged at said open tip.

2. A bullet according to claim 1 wherein said insert comprises tin.

3. A bullet according to claim 1 wherein said unsintered powdered metal composite core comprises tungsten and tin.

4. A bullet according to claim 1 wherein said jacket is a copper alloy.

5. A bullet according to claim 1 wherein said insert consists essentially of 40 grain monolithic tin, said core consists essentially of 80 grain tungsten-tin composite with 75 wt % tungsten and 25 wt % tin, and said jacket consists essentially of 20 grain copper alloy.

6. A bullet according to claim 1 wherein said hollow point tip, tail protrusion, and hollow cavity tip portion is essentially tapered.

7. A bullet according to claim 1 wherein said hollow point tip, tail protrusion, and hollow cavity tip portion is essentially conical.

* * * * *